US006406615B1

(12) United States Patent
Iwamoto et al.

(10) Patent No.: US 6,406,615 B1
(45) **Date of Patent: *Jun. 18, 2002**

(54) HYDROTREATING PROCESS FOR RESIDUAL OIL

(75) Inventors: Ryuichiro Iwamoto; Takao Nozaki, both of Sodegaura (JP)

(73) Assignee: Idemitsu Kosan Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/463,387

(22) PCT Filed: May 25, 1999

(86) PCT No.: PCT/JP99/02743

§ 371 (c)(1),
(2), (4) Date: Mar. 1, 2000

(87) PCT Pub. No.: WO99/61557

PCT Pub. Date: Dec. 2, 1999

(30) Foreign Application Priority Data

| | | |
|---|---|---|
| May 26, 1998 | (JP) | 10-143653 |
| May 26, 1998 | (JP) | 10-143660 |
| Jul. 1, 1998 | (JP) | 10-185500 |

(51) Int. Cl.[7] ..... C10G 45/04

(52) U.S. Cl. ..... 208/213; 208/217; 208/251 H; 208/254 H

(58) Field of Search ..... 208/213, 217, 208/253, 251 H, 254 R, 254 H

(56) References Cited

U.S. PATENT DOCUMENTS

| | | | | |
|---|---|---|---|---|
| 4,485,183 A | * | 11/1984 | Miller et al. | 502/25 |
| 5,139,984 A | | 8/1992 | Iwamoto et al. | |
| 5,141,737 A | | 8/1992 | Iwamoto et al. | |
| 5,154,819 A | * | 10/1992 | Clark et al. | 208/216 R |
| 5,207,893 A | | 5/1993 | Iwamoto et al. | |
| 5,280,004 A | | 1/1994 | Iino et al. | |
| 5,336,394 A | | 8/1994 | Iino et al. | |
| 5,338,437 A | | 8/1994 | Iwamoto et al. | |
| 5,565,091 A | | 10/1996 | Iino et al. | |

* cited by examiner

*Primary Examiner*—Bekir L. Yildirim
(74) *Attorney, Agent, or Firm*—Oblon, Spivak, McClelland, Maier & Neustadt, P.C.

(57) ABSTRACT

The invention relates to a method of heavy oil hydrogenation, precisely to a method of heavy oil hydrogenation for which a part of the catalyst to be used is a regenerated catalyst, and concretely to a method of heavy oil denitrification and to a method of heavy of desulfurization. It is characterized in that heavy oil is passed through a layer of a regenerated catalyst or a layer containing a regenerated catalyst. With the specific catalyst disposition employed in the method, heavy oil can be well hydrogenated under the same conditions as those for ordinary heavy oil hydrogenation with fresh catalysts. The method is significantly effective for efficient utilization of used catalysts.

28 Claims, 12 Drawing Sheets

HYDROTREATING PROCESS FOR RESIDUAL OIL

TECHNICAL FIELD

The present invention relates to a method of hydrogenating heavy-oil. More precisely, it relates to a method of hydrogenating heavy oil with a catalyst partly comprising a regenerated catalyst, concretely, to a method of denitrifying and desulfurizing heavy oil with such a catalyst.

BACKGROUND ART

For petroleum purification, there are many methods of purifying different fractions through hydrogenation. They include desulfurization and denitrification of naphtha, kerosene, light oil, etc.; desulfurization, denitrification and cracking of heavy-gravity light oil; and desulfurization and denitrification of residual oil and heavy oil. Of those, the catalysts used for hydrogenating naphtha, kerosene and light oil all having a relatively low boiling point and containing few metal impurities such as vanadium and others are degraded only a little.

The catalysts used for hydrogenating them will be degraded almost exclusively by a small amount of carbonaceous material deposited thereon. Therefore, the used catalysts could be regenerated and reused if the carbonaceous deposit is removed from them, for example, by firing the deposit. Removing the carbonaceous deposit to regenerate the used catalysts into reusable ones does not require any severe fire control, as the amount of the deposit is small. Even when once used, some used catalysts will be degraded only a little and could be directly reused as they are. Therefore, the catalysts of that type could be used repeatedly for treating naphtha, kerosene, light oil and the like, not requiring any specific care.

Recently, hydrogenation catalysts for heavy-gravity light oil and reduced-pressure light oil have been reused through regeneration or the like, and some methods for regenerating and reusing them have been established. For example, it is known that, in the hydro-cracking process for heavy-gravity light oil, both the hydro-cracking catalyst and the hydro-denitrification catalyst for the pretreatment can be regenerated and reused through hydrogen activation or oxygen activation.

On the catalysts used for hydrogenation of these petroleum distillates, few oil-derived metals such as vanadium and the like deposit, since the distillates contain few metal impurities. In addition, the amount of the carbonaceous material that may deposit on the used catalysts is small and the carbonaceous deposit could be readily fired away. While the catalysts with the carbonaceous deposit thereon are regenerated by firing them, their surfaces will not be heated up to so high temperatures, and the pore structure of the fired catalysts and even the condition thereof to carry the active metal phase therein will change little. Therefore, the regenerated catalysts could be reused with no difficulty for treating petroleum distillates such as heavy-gravity light oil, reduced-pressure light oil and others (Studies in Surface and Catalysis, Vol. 88, p. 199, 1994).

However, in hydrogenation of residual oil having a higher boiling point or of heavy oil containing undistillable fractions, a large amount of metallic material and carbonaceous material deposits on the used catalysts, since the oil to be processed contains a large amount of metal impurities and easily-carbonizing substances such as asphaltene, etc. In addition, from the viewpoint of their quality, the used catalysts having both the metallic deposit and the carbonaceous deposit thereon could not be easily regenerated to remove the deposits therefrom by firing them (Catal. Today, Vol. 17, No. 4, p. 539, 1993; Catal. Rev. Sci. Eng., 33 (3 & 4), p. 281, 1991). For these reasons, the used catalyst have heretofore been discarded without being recycled.

The present invention is to regenerate the catalysts used and deactivated through hydrogenation of heavy oil and others, which have heretofore been discarded without being recycled, and its object is to provide a method of effectively using the regenerated catalysts for hydrogenation of heavy oil.

DISCLOSURE OF THE INVENTION

We, the present inventors have assiduously studied, and, as a result, have found that, when a catalyst having been deactivated through hydrogenation of heavy oil and others is regenerated and when the combination of the regenerated catalyst and a fresh catalyst is optimized, then the combined catalyst system is still effective for hydrogenation of heavy oil. In addition, we have further found that, when the deactivated catalyst is regenerated in such a manner that the amount of the impurities still adhering to the regenerated catalyst and the physical properties of the regenerated catalyst are controlled to fall within a specifically defined range, then the thus-regenerated catalyst is especially effective for hydrogenation of heavy oil. On the basis of these findings, we have completed the present invention.

Specifically, the summary of the invention is as follows:

(1) A method of hydrogenating heavy oil, which is characterized by passing heavy oil through at least a layer of a regenerated catalyst or a layer containing a regenerated catalyst.

(2) A method of hydro-denitrifying heavy oil in a reaction zone filled with a catalyst, which is characterized by catalyst disposition of such that a regenerated catalyst is disposed in the former stage of at least a part of the reaction zone and a fresh catalyst is disposed in the latter stage thereof.

(3) The hydro-denitrifying method of above (2), wherein the amount of the fresh catalyst filled in at least a part of the reaction zone falls between 20 and 95% by volume and that of the regenerated catalyst filled therein falls between 5 and 80% by volume.

(4) A method of hydro-desulfurizing heavy oil in a reaction zone filled with a catalyst, which is characterized by catalyst disposition of such that a fresh catalyst is disposed in the former stage of at least a part of the reaction zone and a regenerated catalyst is disposed in the latter stage thereof.

(5) The hydro-desulfurizing method of above (4), wherein the amount of the regenerated catalyst filled in at least a part of the reaction zone falls between 5 and 80% by volume and that of the fresh catalyst filled therein falls between 20 and 95% by volume.

(6) A method of hydrogenating heavy oil, for which is used a reaction zone comprising at least three reaction layers of regenerated catalyst layers and fresh catalyst layers disposed alternately.

(7) The method of hydrogenating heavy oil of above (6), wherein the liquid hourly space velocity (LHSV) of the heavy oil passing through the regenerated catalyst layer to be hydrogenated therethrough is larger than 1 $hr^{-1}$.

(8) A method of hydrogenating heavy oil, for which is used a reaction zone comprising a regenerated catalyst and a fresh catalyst and having at least a mixed layer of the two.

(9) The method of hydrogenating heavy oil of any one of above (6) to (8), wherein the amount of the regenerated catalyst filled in the reaction zone falls between 5 and 80% by volume and that of the fresh catalyst filled therein falls between 20 and 95% by volume.

(10) The method of hydrogenating heavy oil of any one of above (1) to (9), wherein the vanadium content of the regenerated catalyst is at most 35% by weight.

(11) The method of hydrogenating heavy oil of any one of above (1) to (10), wherein the carbon content of the regenerated catalyst is at most 15% by weight.

(12) The method of hydrogenating heavy oil of any one of above (1) to (11), wherein the specific surface area of the regenerated catalyst falls between 60 and 200 $m^2/g$.

(13) The method of hydrogenating heavy oil of any one of above (1) to (12), wherein the pore volume of the regenerated catalyst falls between 0.3 and 1.0 cc/g.

(14) The method of hydrogenating heavy oil of any one of above (1) to (13), wherein the regenerated catalyst is from a used catalyst having at least one metal of molybdenum, tungsten, cobalt and nickel carried on an oxide carrier, the catalyst having been used for hydrogenating mineral oil and then regenerated.

(15) The method of hydrogenating heavy oil of above (14), wherein the oxide carrier is alumina, and the metal carried on it is nickel and molybdenum.

(16) The method of hydrogenating heavy oil of above (14), wherein the oxide carrier is alumina containing at least one oxide of phosphorus, boron or silicon, and the metal carried on it is nickel or cobalt, and molybdenum.

(17) The method of hydrogenating heavy oil of any one of above (14) to (16), wherein the nickel or cobalt content of the catalyst having the metal carried on its carrier falls between 0.1 and 10% by weight and the molybdenum content thereof falls between 0.1 and 25% by weight.

(18) The method of hydrogenating heavy oil of any one of above (10) to (17), which is for hydro-denitrifying heavy oil.

(19) The method of hydrogenating heavy oil of any one of above (10) to (17), which is for hydro-desulfurizing heavy oil.

Figure 1:
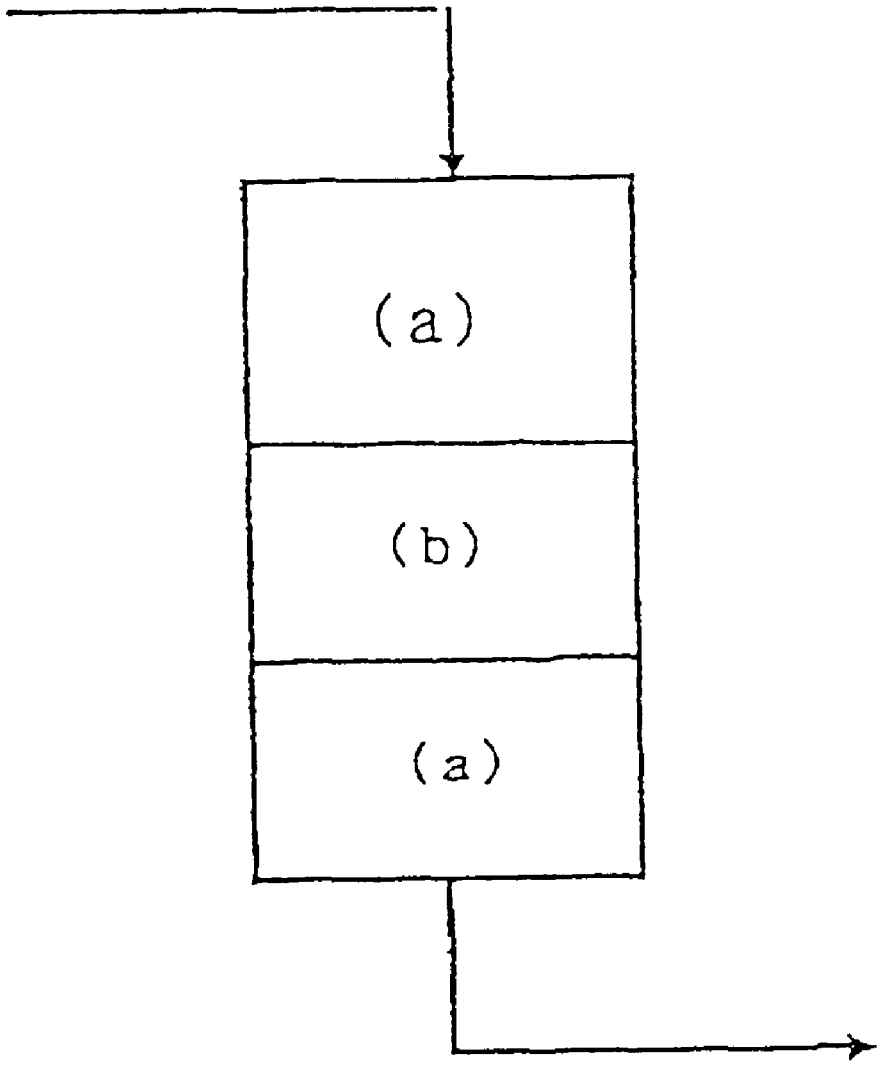
FIG. 1 is a conceptual view illustrating case 1 of the third aspect of the invention. In this, the rectangular outline indicates a reactor (reaction zone); and the upper and lower lines arrowed therearound indicate the route of heavy oil being introduced into the reactor and that of the processed product being taken out of it, respectively. The rectangles as specifically designated by (a) and (b) in the reactor indicate different catalyst layers. (The same shall apply to the other drawings referred to herein.)

In these drawings, the reference code (a) indicates a fresh catalyst layer; (b) indicates a regenerated catalyst layer; and (c) indicates a mixed catalyst layer.

BEST MODES OF CARRYING OUT THE INVENTION

Modes of carrying out the invention are described below.

1. Characteristic features of the invention:

In the invention of hydrogenating heavy oil, heavy oil must be passed through at least a layer of a regenerated catalyst or a layer containing a regenerated catalyst. Specifically, the invention is characterized in that heavy oil to be processed is passed through a layer filled with only a regenerated catalyst or through a layer containing a regenerated catalyst, or that is, a layer of a mixed catalyst of a regenerated catalyst and a fresh catalyst, but not through only a catalyst layer filled with only a fresh catalyst, as will be described in detail hereinunder. The order of the fresh catalyst-filled layer and the regenerated catalyst-filled layer through which heavy oil is first passed is not specifically defined, but may be suitably selected from various embodiments to be mentioned hereinunder, depending on the object of the invention.

Various embodiments of the invention all satisfying the intended object are described below.

(1) Method of hydro-denitrification (first aspect of the invention):

The first aspect of the invention is a method of hydro-denitrifying heavy oil in a reaction zone filled with a catalyst, which is characterized by using a specific combination of a regenerated catalyst and a fresh catalyst. Specifically, the hydro-denitrifying method is characterized by specific catalyst disposition of such that a regenerated catalyst is disposed in the former stage of at least a part of the reaction zone and a fresh catalyst is disposed in the latter stage thereof.

Heavy oil is processed for various purposes through hydrogenation. The essential object of the process of heavy oil hydrogenation is for desulfurization and cracking of heavy oil. In many cases, however, the process is also for reducing the nitrogen content of the processed oil. For example, in the process of desulfurization for heavy oil production, the sulfur content and also the nitrogen content and the metal content of the product heavy oil are important quality control items in many cases. The process of desulfurization of heavy oil is often employed for pretreatment for the catalytic cracking process for gasoline production. The crude oil to be catalytically cracked for that purpose is required to have a reduced sulfur content and even a reduced nitrogen content as the important factors of itself. On the other hand, in the hydro-cracking process of crude oil, the nitrogen compound which may be in the crude oil and which will act as a catalyst poison to the cracking catalyst will have to be previously removed from the crude oil through pre-denitrification.

The denitrification in the process of hydrogenating heavy oil is meant to indicate various types of denitrification such as those mentioned above, naturally including the denitrification to be effected for the essential object of itself but even any other types of denitrification to be effected along with other reactions or to be effected as pre-treatment or post-treatment for other reactions. In the hydro-cracking process in which the denitrification is effected for the pre-treatment of the cracking catalyst to be used, the pre-treatment shall correspond to the denitrification discussed herein.

The catalyst to be filled in the reaction zone as referred to herein includes not only the catalyst for only denitrification but also any other catalysts essentially for desulfurization, de-scaling or metal removal so far as they have the activity of denitrification and actually act for denitrification in the reaction zone. Accordingly, the reaction zone in the process of desulfurization and also denitrification of heavy oil will be meant to indicate not only an ordinary denitrification reaction zone in the narrow sense of the word but also the entire reaction zone for the desulfurization process with various catalyst layers that covers a desulfurization zone, a metal-removing zone, a de-scaling zone, etc. At least a part of the reaction zone in that sense shall indicate not only the narrow-sense denitrification zone, desulfurization zone, metal-removing zone, de-scaling zone or the like but also a part of the individual reactors in the entire reaction zone and a part of the individual catalyst beds in each reactor. That part of the reaction zone may cover an area that bridges a downstream area of one reactor and the upstream area of the next reactor. Accordingly, the wording "at least a part of the reaction zone" as referred to herein shall indicate any and every one integrated part in which heavy oil is denitrified even in some degree irrespective of the object essential to or subsidiary to the invention.

Typical embodiments of a part the reaction zone include one entire denitrification zone, a combination of plural reactors connected in series, one reactor, one catalyst bed only in a reactor, etc. As the case may be, the reaction zone for denitrification with metal removal and the reaction zone for denitrification with desulfurization may be considered as different zones. In that case, each of the two reaction zones may be divided into a former stage and a latter stage in which the catalyst is disposed as specifically defined herein. However, the wording "at least a part of the reaction zone" as referred to herein for specific catalyst disposition shall not include catalyst zones not participating at all in denitrification. For example, the catalyst zone for only hydro-cracking is outside the scope of the denitrification zone.

Regarding the catalyst disposition in the invention, it is important that a regenerated catalyst is in the former stage of at least a part of the reaction zone and a fresh catalyst is in the latter stage thereof. This is because the specific catalyst disposition enables effective denitrification of heavy oil in such a preferred manner that the easily-removable nitrogen compound existing in heavy oil is first removed through denitrification with the regenerated catalyst and thereafter the other nitrogen compound which still remains in the thus-processed heavy oil and which is poorly reactive is removed through denitrification with the fresh catalyst having a relatively high activity. For this, a regenerated catalyst having a relatively lower hydrogenation activity shall be disposed in the former stage and a fresh catalyst having a relatively higher hydrogenation activity in the latter stage to attain better results.

In order that a part of the reaction zone (this will be hereinafter referred to as "specific reaction zone") could satisfactorily attain the intended object in the hydro-denitrification process, it is desirable that the fresh catalyst accounts for at least 20% of the specific zone (this indicates % by volume of the total catalyst in the specific reaction zone filled with the catalyst, and the same shall apply hereinunder), more preferably at least 40% thereof. On the contrary, however, it is desirable that the amount of the regenerated catalyst in the specific zone is at least 5%, more preferably at least 10%. If not, the improvement in the denitrification by the specific catalyst disposition in the invention will not be significant.

The former stage and the latter stage for the catalyst disposition as referred to herein indicate the upstream area of the reaction flow and the downstream area thereof, respectively. Accordingly, the catalyst disposed in a relatively upstream area shall be one in the former stage, and that disposed in a relatively downstream area shall be in the latter stage.

(2) Method of hydro-desulfurization (second aspect of the invention):

The second aspect of the invention is a method of hydro-desulfurizing heavy oil in a reaction zone filled with a catalyst, which is characterized by using a specific combination of a regenerated catalyst and a fresh catalyst. Specifically, the hydro-desulfurizing method is characterized by specific catalyst disposition of such that a fresh catalyst is disposed in the former stage of at least a part of the reaction zone and a regenerated catalyst is disposed in the latter stage thereof. The catalyst to be filled in the reaction zone includes not only the catalyst for only desulfurization but also any other catalysts essentially for de-scaling or metal removal. Accordingly, the reaction zone will be meant to indicate not only an ordinary desulfurization reaction zone in the narrow sense of the word but also the entire reaction zone for the desulfurization process with various catalyst layers that covers a metal-removing zone, a de-scaling zone, etc.

At least a part of the reaction zone in that sense may be the entire reaction zone, but including any of the narrow-sense desulfurization zone, metal-removing zone, de-scaling zone or the like, as well as a part of those reaction zones and also a combination of a plurality of such reaction zones. It further includes one reactor and even one catalyst bed part in a reactor. As the case may be, it may cover an area that bridges a downstream area of one reactor and the upstream area of the next reactor. Accordingly, the wording "at least a part of the reaction zone" as referred to herein shall indicate any and every one integrated part in which heavy oil is desulfurized even in some degree irrespective of the object essential to or subsidiary to the invention.

Typical embodiments of a part the reaction zone include a metal-removing zone only, a narrow-sense desulfurization zone except metal-removing and de-scaling zones, one or plural reactors in the desulfurization zone, and one or plural catalyst beds in a reactor.

Regarding the catalyst disposition in the invention, it is important that a fresh catalyst is in the former stage of at least a part of the reaction zone and a regenerated catalyst is in the latter stage thereof. This is because desulfurization of heavy oil is greatly interfered with the aromatic component of the starting heavy oil. Therefore, it is believed that a method of first hydrogenating as much as possible the starting heavy oil and thereafter further hydrogenating the resulting hydrogenate intermediate to give desulfurized oil and hydrogen sulfide will be effective desulfurization of heavy oil. For this, a fresh catalyst having a relatively higher hydrogenation activity shall be disposed in the former stage and a regenerated catalyst having a somewhat lower hydrogenation activity in the latter stage to attain better results.

In order that a part of the reaction zone (this will be hereinafter referred to as "specific reaction zone") could satisfactorily attain the intended object in the hydro-desulfurization process, it is desirable that the fresh catalyst accounts for at least 20% of the specific zone (this indicates % by volume of the total catalyst in the specific reaction zone filled with the catalyst, and the same shall apply hereinunder), more preferably at least 40% thereof. On the contrary, however, it is desirable that the amount of the regenerated catalyst in the specific zone is at least 5%, preferably at least 10%. If not, the improvement in the desulfurization by the specific catalyst disposition in the invention will not be significant.

The former stage and the latter stage for the catalyst disposition as referred to herein indicate the upstream area of the reaction flow and the downstream area thereof, respectively. Accordingly, the catalyst disposed in a relatively upstream area shall be one in the former stage, and that disposed in a relatively downstream area shall be in the latter stage.

(3) Method of hydrogenation (third aspect of the invention):

The third aspect of the invention is a method of hydrogenating heavy oil in a reaction zone filled with a catalyst, which is characterized by specific disposition of a regenerated catalyst and a fresh catalyst in the reaction zone. Heavy oil processing is seldom directed to only either one of desulfurization or denitrification, but is often directed to both the two in a well balanced manner. Therefore, it is effective for that purpose to combine the first and second aspects of the invention.

One embodiment of the combination is hydrogenation of heavy oil in a reaction zone filled with a catalyst, in which the catalyst is do disposed that regenerated catalyst layers and fresh catalyst layers are disposed alternately in at least three layers.

Figure 2:
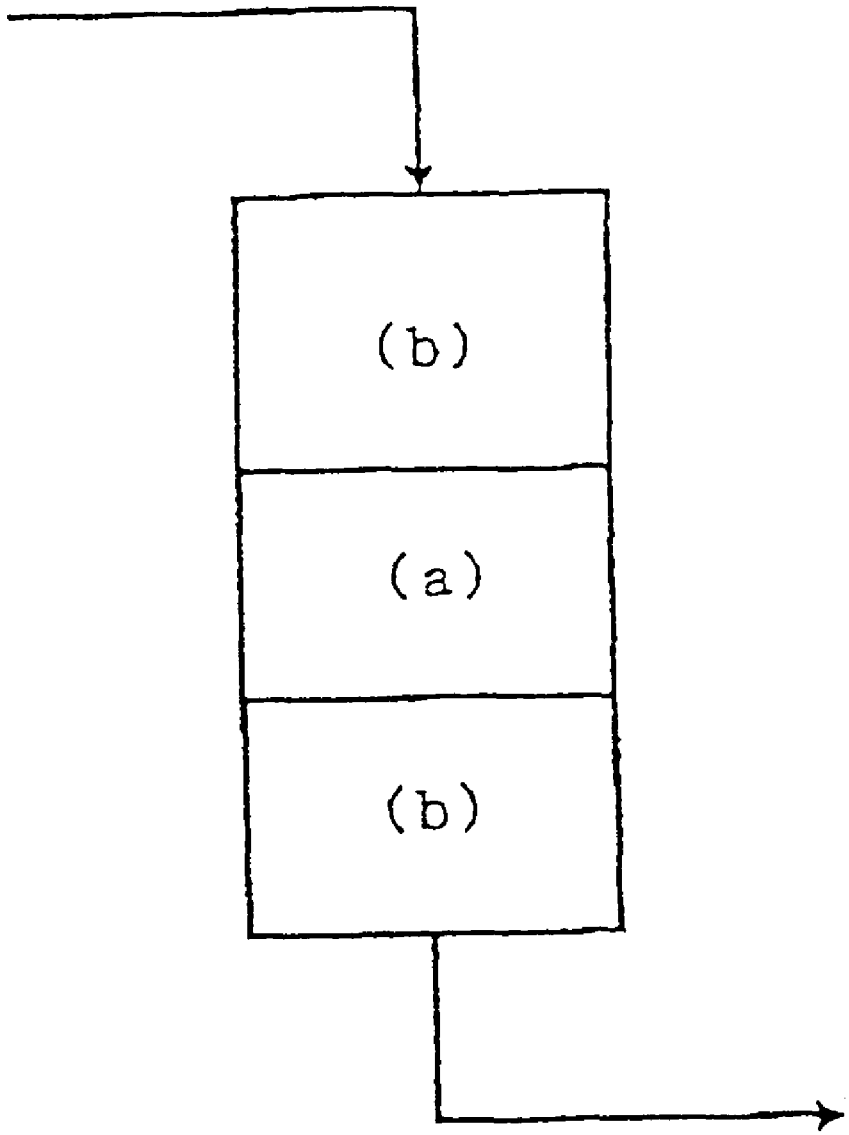
FIG. 2 is a conceptual view illustrating case 2 of the third aspect of the invention.

The most basic cases of the embodiment is case 1 illustrated in FIG. 1 and case 2 in FIG. 2. The catalyst disposition of case 1 is the most popular one for hydro-desulfurization of heavy oil, for which a fresh catalyst layer (for hydro-desulfurization of heavy oil, this preferably comprises a catalyst for metal removal and a catalyst for desulfurization), a regenerated catalyst layer (for hydro-desulfurization of heavy oil, this is preferably a desulfurization catalyst layer), and a fresh catalyst layer (for hydro-desulfurization of heavy oil, this is preferably a desulfurization catalyst layer) are disposed in that order from the upstream side of the oil flow.

The catalyst disposition of case 2 is opposite to that of case 1, for which a regenerated catalyst layer, a fresh catalyst layer and a regenerated catalyst layer are disposed in that order from the upstream of the oil flow. Case 2 is suitable to hydro-cracking of heavy oil. Specifically, in case 2, a regenerated catalyst still having good capability for metal removal may be in the first regenerated catalyst layer; a fresh hydro-cracking catalyst may be in the next fresh catalyst layer; and a regenerated catalyst for post-desulfurization may be in the last regenerated catalyst layer.

The basic catalyst disposition in the invention is as above. For attaining satisfactory hydrogenation of heavy oil in those cases, the liquid hourly space velocity (LHSV) of the heavy oil passing through the catalyst layers is desirably as small as possible so that the heavy oil could have plenty of residence time in the layers. However, if the heavy oil being processed has too much residence time in the regenerated catalyst layer, it will unfavorably pyrolyze or give carbonaceous products therein. To evade such unfavorable side reactions, it will be desirable that, after the heavy oil has been kept for a predetermined period of residence time in one regenerated catalyst layer, it is transferred into the next fresh catalyst layer having high capability for hydrogenation so that it can undergo hydrogenation therein to a satisfactory degree without being accompanied by unfavorable side reactions of pyrolysis or carbonization to give unfavorable carbonaceous side products. For this, it will be desirable that the regenerated catalyst layers and the fresh catalyst layers are combined and disposed in at least three layers and that the heavy oil that passes through the layers could have LHSV through each one regenerated layer of at least 1 $hr^{-1}$, more preferably at least 1.5 $hrs^{-1}$.

Figure 3:
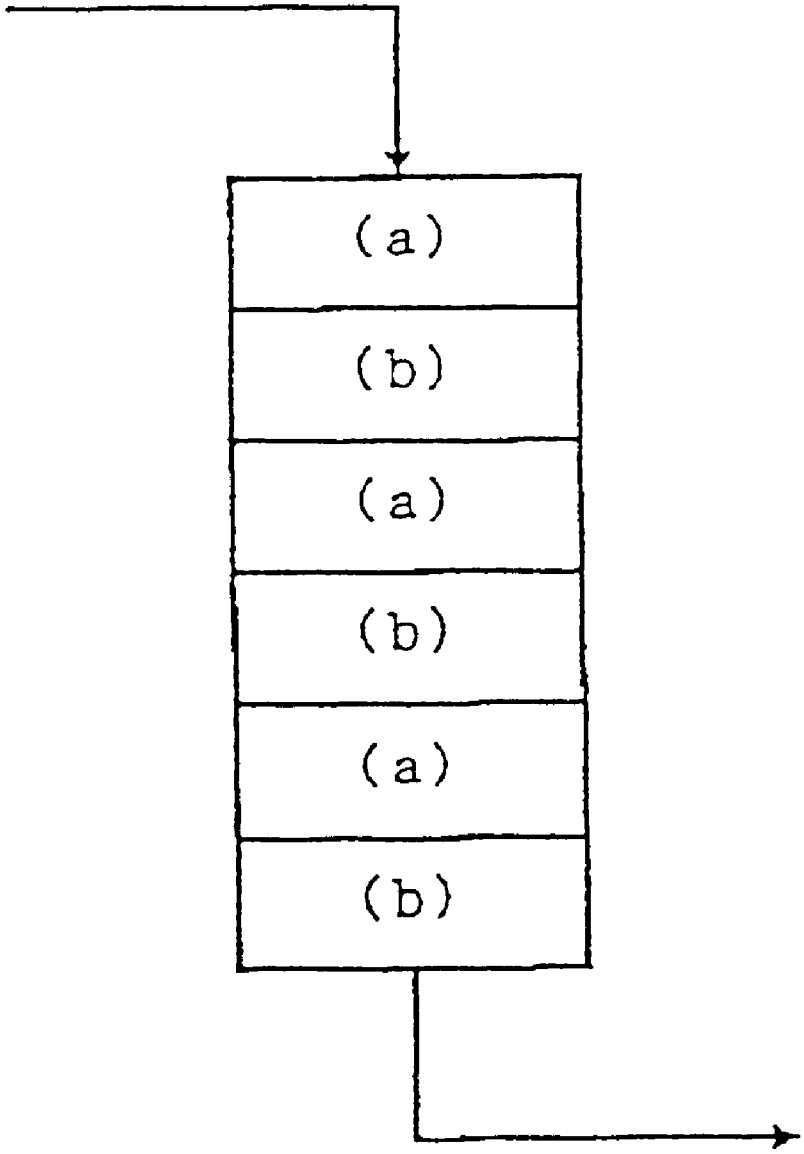
FIG. 3 is a conceptual view illustrating case 3 of the third aspect of the invention. In this, the reactor is seen to be composed of six catalyst layers. However, this shall conceptually show at least 4 catalyst layers of (a) and (b) as alternately and repeatedly disposed in the illustrated order.
Figure 4:
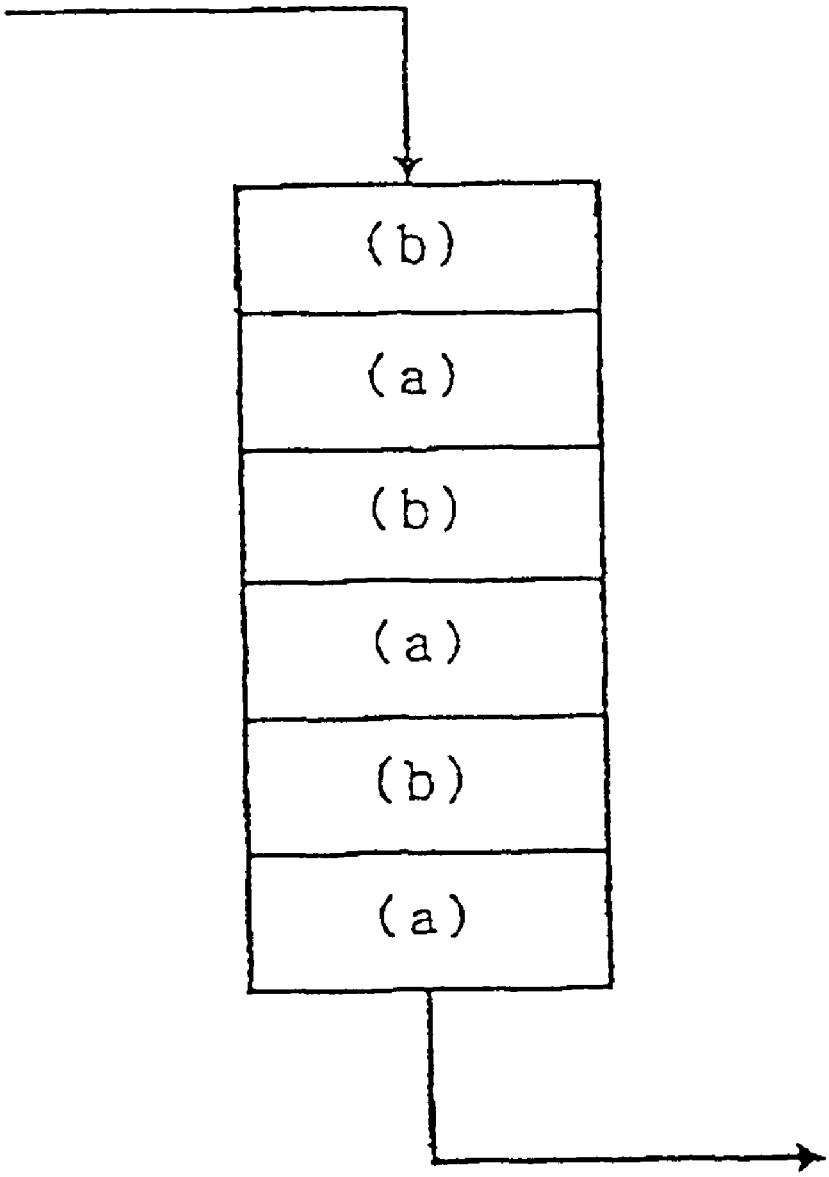
FIG. 4 is a conceptual view illustrating case 4 of the third aspect of the invention. (The same as in FIG. 3 shall apply to this.)

Case 3 illustrated in FIG. 3 and case 4 in FIG. 4 are preferred cases of the catalyst disposition as above. In addition, these are for the method of using a plurality of regenerated catalysts having different functions in which the plural regenerated catalysts are disposed in plural layers.

Figure 5:
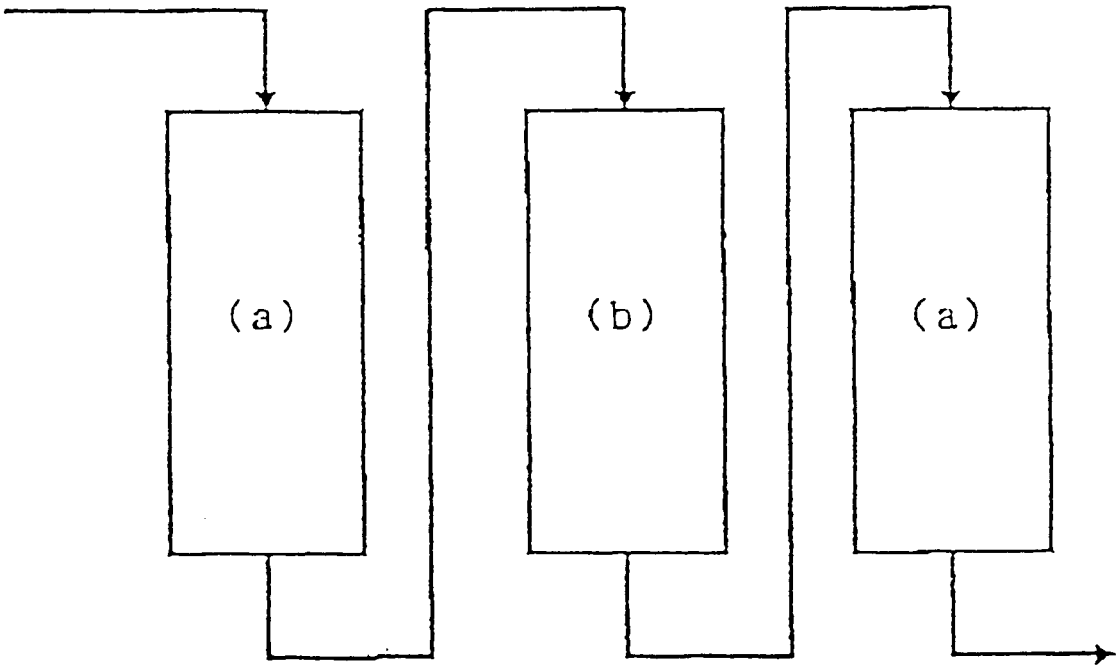
FIG. 5 is a conceptual view illustrating case 5 of the third aspect of the invention. In this, the rectangles indicate different reactors, and the lines arrowed therearound indicate the route of heavy oil being introduced into and having passed through the reactors and that of the processed product being taken out of them, respectively. The three reactors constitute one reaction zone. (The same shall apply hereinunder.)
Figure 6:
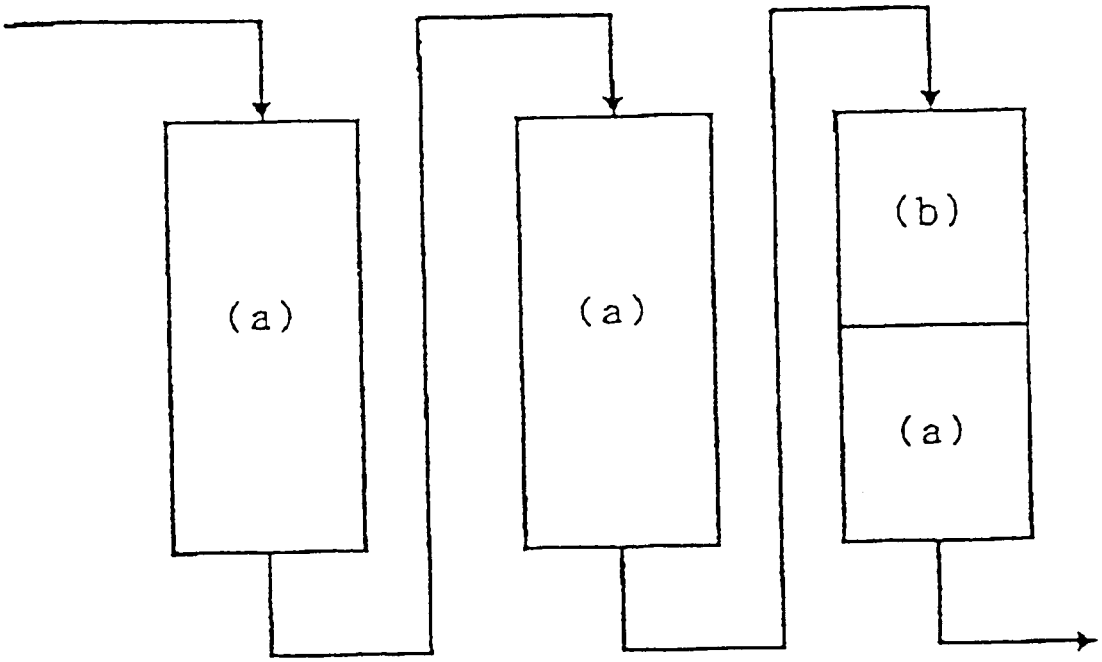
FIG. 6 is a conceptual view illustrating case 6 of the third aspect of the invention.

In many practical devices for hydrogenation of heavy oil, for example, for hydro-desulfurization thereof, at least 2 reactors are connected as in case 5 of FIG. 5 or case 6 of FIG. 6. (In the cases of FIG. 5 and FIG. 6, three reactors are connected.) In those cases, each reactor may be filled with a fresh catalyst or a regenerated catalyst to have a fresh catalyst layer or a regenerated catalyst layer therein; or one reactor may have both a fresh catalyst layer and a regenerated catalyst layer. In particular, the catalyst layer disposition for heavy oil hydro-desulfurization as in case 6 is preferred, as it could produce better hydrogenation results.

In another embodiment of heavy oil hydrogenation of the invention, a regenerated catalyst and a fresh catalyst are so disposed that the two are mixed in one mixed layer.

Figure 7:
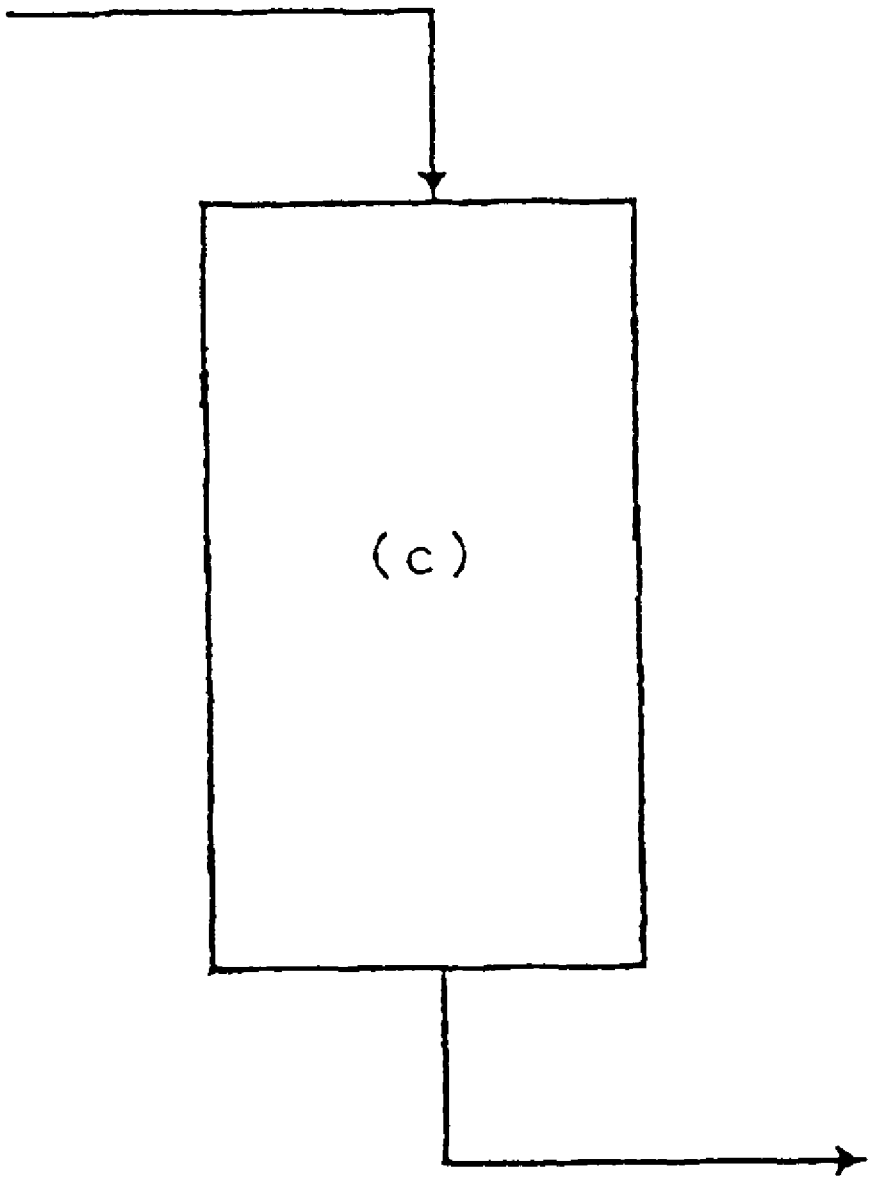
FIG. 7 is a conceptual view illustrating case 7 of the third aspect of the invention.
Figure 8:
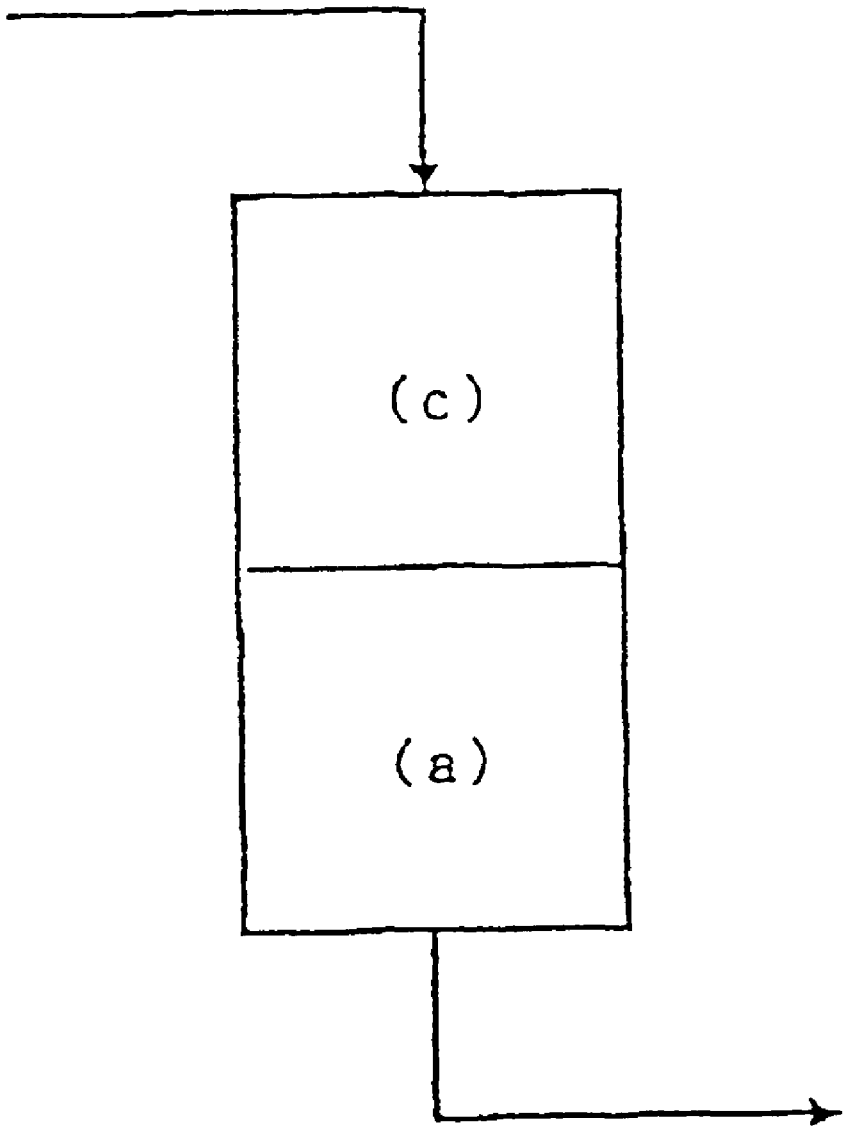
FIG. 8 is a conceptual view illustrating case 8 of the third aspect of the invention.
Figure 9:
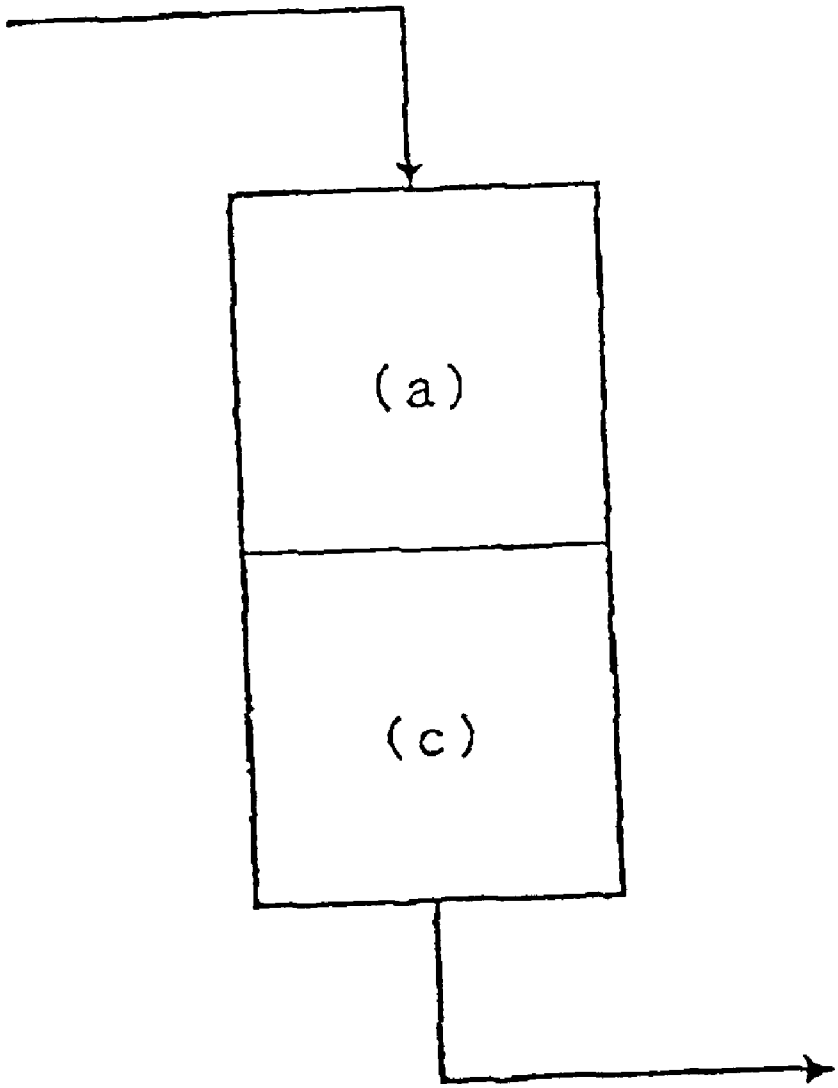
FIG. 9 is a conceptual view illustrating case 9 of the third aspect of the invention.
Figure 10:
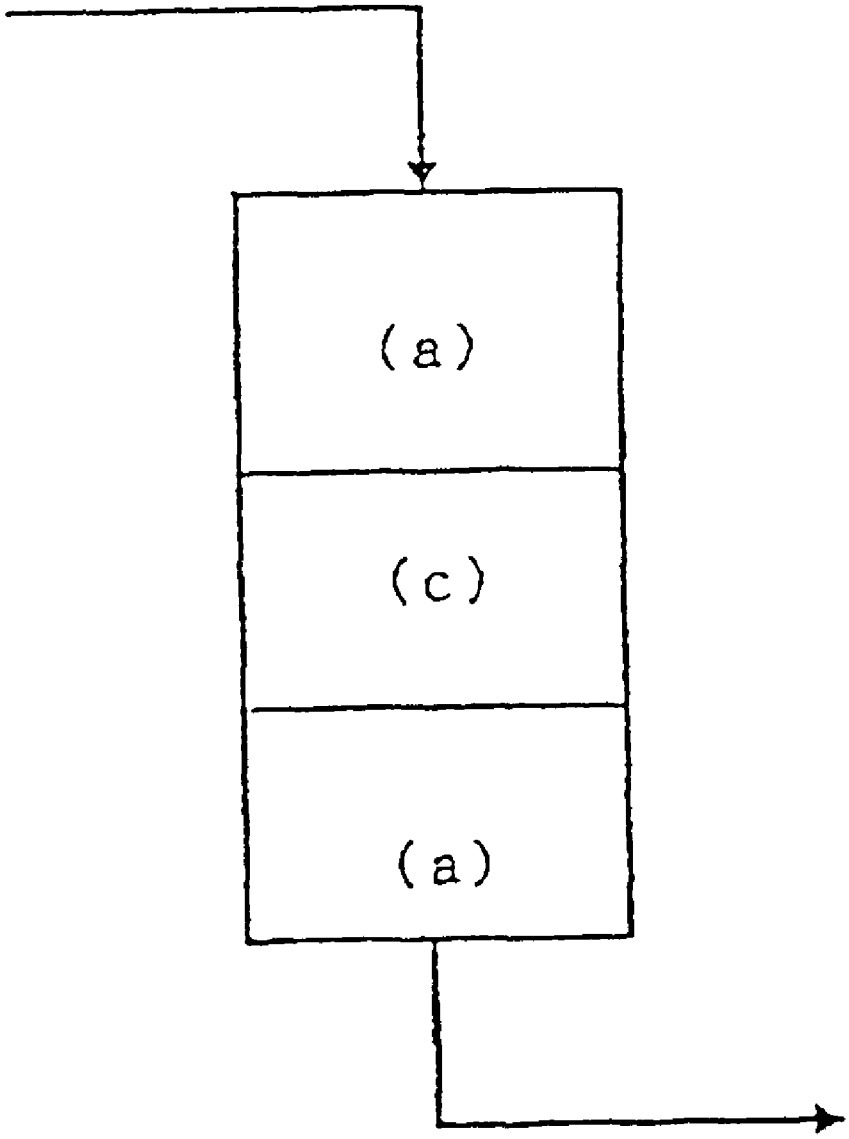
FIG. 10 is a conceptual view illustrating case 10 of the third aspect of the invention.
Figure 11:
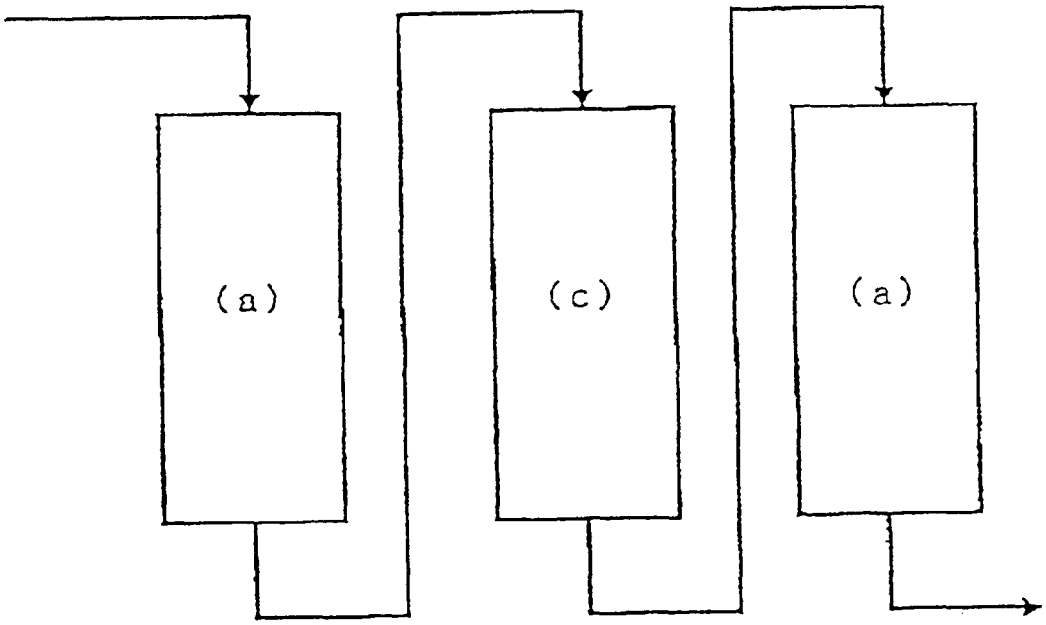
FIG. 11 is a conceptual view illustrating case 11 of the third aspect of the invention.
Figure 12:
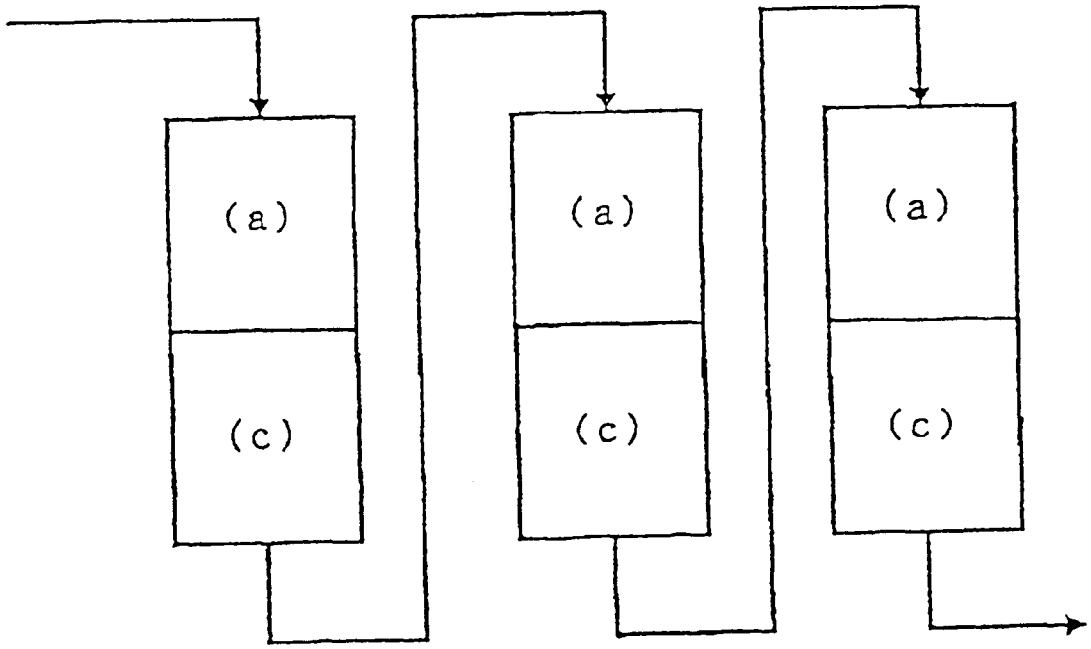
FIG. 12 is a conceptual view illustrating case 12 of the third aspect of the invention.

Case 7 of FIG. 7 is the basic catalyst disposition of this embodiment, in which the mixed layer is filled in one reactor. Case 8 of FIG. 8 and case 9 of FIG. 9 are modifications of the basic catalyst disposition. FIG. 10 (case 10) illustrates a modification of case 1 and case 7. This comprises reactors (a) and (c). In this, however, the reactor (a) may be replaced with a reactor (b). For a plurality of reactors to be connected, employable are embodiments of FIG. 11 and FIG. 12. In the embodiment of FIG. 12, the ratio of the regenerated catalyst to the fresh catalyst may vary in different mixed layers. In addition, the regenerated catalyst and the fresh catalyst may be so combined that the ratio of the two differs in one mixed layer. Needless-to-say, plural reactors may be so connected that some of them are of a catalyst layer of a regenerated catalyst alone.

Heavy oil is processed for various purposes through hydrogenation. The essential object of the process of heavy oil hydrogenation is for desulfurization and cracking of heavy oil. In many cases, however, the process is also for reducing the metal content and the nitrogen content of the processed oil. For example, in the process of desulfurization for heavy oil production, the sulfur content and also the nitrogen content and the metal content of the product heavy oil are important quality control items in many cases. The process of desulfurization of heavy oil is often employed for pretreatment for the catalytic cracking process for gasoline production. The crude oil to be catalytically cracked for that purpose is required to have a reduced sulfur content and even a reduced metal content, a reduced nitrogen content and a reduced heavy aromatic content as the important factors of itself. On the other hand, in the hydro-cracking process of crude oil, the nitrogen compound which may be in the crude oil and which will act as a catalyst poison to the cracking catalyst will have to be previously removed from the crude oil through pre-denitrification.

Heavy oil hydrogenation as referred to herein is meant to indicate various types of hydrogenation of heavy oil such as those mentioned above, naturally including desulfurization, metal removal treatment, denitrification, cracking and others for processing heavy oil. Needless-to-say, combinations of one reaction for dehydrogenation with any others, and also the pre-treatment and the post-treatment to be effected before or after the main reaction for hydrogenation shall be within the scope of the terminology, heavy oil hydrogenation referred to herein.

The catalyst to be filled in the reaction zone as referred to herein includes not only the catalyst for only one limited function but also any other catalysts essentially for desulfurization, de-scaling or metal removal, further including even others for denitrification as combined with the essential function.

The third aspect of the invention is preferable to using a reaction zone that comprises a regenerated catalyst and a fresh catalyst merely combined in series therein, as leading to favorable hydro-desulfurization of heavy oil, favorable hydro-denitrification thereof and even favorable hydrogenation thereof for metal removal. Concretely, one problem with heavy oil hydrogenation through a reaction zone where a fresh catalyst layer is disposed in the former stage and a regenerated catalyst layer is in the latter stage is that the heavy oil being processed could be favorably desulfurized with metals being also favorably removed from it, but its denitrification is difficult. On the other hand, heavy oil hydrogenation through a reaction zone where a regenerated catalyst layer is disposed in the former stage and a fresh catalyst is in the latter stage is also problematic in that the heavy oil being processed could be favorably denitrified but is hardly desulfurized and, in addition, metal removal from it is difficult. The catalyst disposition in the third aspect of the invention solves the problems with the two cases, and leads to more efficient heavy oil hydrogenation, taking the advantages of the two cases. For better results in the heavy oil hydrogenation of this aspect, using too much regenerated catalyst is unfavorable. In this aspect, it is desirable that the fresh catalyst to be used accounts for at least 20% of the entire catalyst zone (this indicates % by volume of the total catalyst in the entire reaction zone filled with the catalyst, and the same shall apply hereinunder), more preferably at least 40% thereof. On the contrary, however, it is desirable that the amount of the regenerated catalyst in the entire catalyst zone is at least 5%, more preferably at least 10%. If not, the improvement in the heavy oil hydrogenation by the specific catalyst disposition in this aspect of the invention will not be significant.

2. Details of the invention (first to third aspects mentioned above):

(1) Heavy oil as referred to herein includes petroleum distillation residues such as normal-pressure residual oil, reduced-pressure residual oil and the like residual fractions, but does not include fractions of distillate oil only, such as kerosene, light oil, reduced-pressure light oil, etc. In general, heavy oil has a sulfur content of 1% by weight or more, a nitrogen content of 200 ppm by weight or more, a residual carbonaceous content of 5% by weight or more, a vanadium content of 5 ppm or more, and an asphaltene content of 0.5% or more. For example, it includes, in addition to the normal-pressure residual oil and other residual fractions noted above, crude oil, asphalt oil, thermally-cracked oil, tar-sand oil, and even mixed oil comprising them. For the heavy oil hydrogenation of the invention, used are fixed-bed reactors. The process of the invention is not directed to any other moving-bed reactors, boiling-bed reactors, etc. The oil flow through the reaction may be either in the up-flowing direction or in the down-flowing direction.

(2) The fresh catalyst, the regenerated catalyst, and the regeneration of catalysts are described. The fresh catalyst for use in the invention is one as prepared for hydrogenation of mineral oil, preferably for desulfurization, metal removal, denitrification, cracking and the like of mineral oil, or may be of any others additionally having the capabilities of hydrogenation that includes desulfurization, metal removal, denitrification, cracking and the like of mineral oil. As the fresh catalyst to that effect, for example, usable are ordinary, commercially-available hydro-desulfurization catalysts, hydrogenating and metal-removing catalysts, etc. As the case may be, specific catalysts having the function of oil hydrogenation may be prepared for use herein. The fresh catalyst includes not only those not used anywhere for oil hydrogenation but also those having been once used for oil hydrogenation with using them being stopped within a short period of time owing to machine trouble or the like, and therefore capable of being again used directly as they are. For the latter, even the catalysts having been once used only within a short period of time are within the scope of the fresh catalyst, so far as they still have the original hydrogenation activity without being specifically processed for re-activation.

The regenerated catalyst as referred to herein is one as obtained by regenerating a used catalyst. Specifically, a fresh catalyst such as that noted above is once used for hydrogenation of heavy oil or the like to such a degree that the used catalyst could no more have a satisfactory degree of hydrogenation activity (this is hereinafter referred to as used catalyst), and the used catalyst in that condition is re-activated through regeneration treatment into the regenerated catalyst for use herein. The dehydrogenation which the fresh catalyst undergoes is generally desulfurization, but may include any others of, for example, metal removal, denitrification, removal of aromatic residues, and cracking. In general, catalysts used for processing heavy oil are regenerated into the regenerated catalysts for use herein. However, catalysts used for hydrogenating distillate oil fractions such as heavy-gravity light oil and others may be regenerated into the regenerated catalysts for use herein. Anyhow, the regenerated catalyst referred to herein encompasses all types of used and regenerated catalysts that can be again used for heavy oil hydrogenation.

To regenerate them, for example, used catalysts may be washed with solvents to remove oily residues from them; they are fired to remove carbonaceous residues, sulfur residues, nitrogen residues and others from them; or they are screened to remove the aggregated blocks or the pulverized fine grains from them and to select normally-shaped grains from them. Preferably, in the invention, used catalysts are oxidized to remove carbonaceous residues from them, thereby obtaining the intended regenerated catalysts usable herein. More preferably, used catalysts are taken out of reactors and oxidized outside the reactors to remove carbonaceous residues from them. In the regeneration treatment, it is not always necessary to completely remove all carbonaceous residues from the used catalysts.

One preferred embodiment of regenerating used catalysts is described. The used catalyst to be regenerated is first washed with a solvent. As the solvent, preferably used are toluene, acetone, alcohol, and petroleum fractions such as naphtha, kerosene, light oil, etc. Any other solvents are usable, so far as they can easily dissolve the organic substances having adhered to the used catalysts. To wash the used catalyst, light oil may be circulated through the hydrogenation reactor in which the catalyst is still therein, and thereafter nitrogen gas or the like may be passed through it at a temperature falling between 50 and 200° C. or so thereby drying the catalyst. In another embodiment, the catalyst having been first washed with the circulating light oil is taken out of the reactor, and is kept wetted with the light oil to prevent it from becoming too hot or from being spontaneously fired, and thereafter it may be dried in any desired time. In still another embodiment, the used catalyst taken out of the reactor may be ground to pulverize the aggregates; or the powdery fragments and also scale and other impurities may be removed from it. In this, the thus-processed, used catalyst is washed with light oil and then with naphtha, and is thereafter dried. The mechanical pre-treatment facilitates the step of washing and drying the used catalyst. Toluene is favorable to washing a small amount of the used catalyst, as completely removing oily residues from it.

The catalyst having been thus washed to remove oily residues and impurities from it must be oxidized to remove carbonaceous residues, in order that the catalyst could exhibit its activity to a satisfactory degree. To oxidize it, in general, the catalyst is fired in an oxidizing atmosphere having a controlled temperature and a controlled oxygen concentration. If the temperature of the atmosphere is too high, or if the oxygen content thereof is too large, the surface of the catalyst will be heated too much so that the crystal morphology of the metal carried therein and even the metal-carrying condition of the catalyst will vary, or the pores existing in the carrier of the catalyst will reduce and the activity of the catalyst will be lowered. On the contrary, if the temperature of the atmosphere is too low, or if the oxygen content thereof is too small, the carbonaceous residues existing in the catalyst could not be sufficiently fired and removed away, and regenerating the catalyst to make it have a satisfactory degree of activity will be impossible. Preferably, the atmosphere temperature falls between 200 and 800° C., more preferably between 300 and 600° C.

It is desirable that the oxygen content of the oxidizing atmosphere is controlled to fall between 1 and 21%. However, depending on the firing method, especially on the condition how the catalyst is contacted with the firing gas, the oxygen content of the atmosphere may be controlled to fall within a desired range. It is important to oxidize and remove the carbonaceous residues from the catalyst while controlling the surface temperature of the catalyst by varying the temperature and the oxygen content of the atmosphere and varying the flow rate of the atmosphere gas. It is also important to prevent the regenerated catalyst from having a reduced specific surface area and a reduced pore volume, while preventing the crystal structure of the hydrogenation-active metal, nickel or molybdenum, in the catalyst from being varied through the oxidation treatment, and further preventing the condition of the crystal grains carried in the catalyst from being varied therethrough.

It is desirable that the fired catalyst is screened through sieving or the like to remove powdery fine grains and others, thereby selecting only the normally-shaped grains from it for use here in as the regenerated catalyst. If not screened, the catalyst layer will be clogged with the oil flow running therethrough or the oil flow will be undesirably channeled through the catalyst layer, whereby the flow pressure loss in the reactor will increase and it would become impossible to smoothly drive the reaction system, even though the initial activity of the regenerated catalyst could be high to a satisfactory degree.

(3) The composition and the physical properties of the regenerated catalyst are described.

The vanadium content and the carbonaceous substance content of catalysts having been used for hydrogenation are the factors indicating the degree of degradation of the used catalysts. In general, vanadium is not in catalysts for hydrogenation, but is derived from minor impurities in crude oil to be hydrogenated. Therefore, the vanadium content of used catalysts could be one factor indicating the degree of degradation of the used catalysts. Of the regenerated catalyst for use herein, the vanadium content is preferably at most 35%, more preferably at most 20%, even more preferably from 3 to 15%. (In this connection, the metal content of the catalyst referred to herein is based on the weight of the catalyst having been oxidized at a temperature not lower than 400° C. until it shows no more weight loss, and is represented in terms of % by weight of the metal in the form of its oxide. The same shall apply to the content of other metals in catalysts.) If the vanadium content of the regenerated catalyst is larger than 35%, the activity thereof will be too low. If such a low-activity regenerated catalyst is used herein, hydrogenation could not be attained to a satisfactory degree. On the other hand, if its vanadium content is smaller than 2%, the regenerated catalyst still has its satisfactorily high activity. Even though such a high-activity regenerated catalyst is specifically disposed as in the invention, the difference between the specific catalyst disposition and any other ordinary catalyst disposition for hydrogenation will be small. Therefore, in the invention, the vanadium content of the regenerated catalyst to be used preferably falls between 2 and 35%, more preferably between 3 and 15%. With the vanadium content falling within the preferred range, the specific catalyst disposition of the regenerated catalyst produces better results.

For elementary analysis for vanadium and others, the sample to be analyzed is fired at 650° C. for 1 hour. For Mo, P and V, the resulting ash is dissolved in an acid and the resulting solution is analyzed through inductively-coupled plasma emission absorptiometry; and for Co, Ni and Al, the ash is mixed with lithium tetraborate, the resulting mixture is formed into glass beads under high-frequency heat, and the glass beads are analyzed through fluorescent X-ray spectrometry.

Also preferably, the carbon content of the regenerated catalyst for use in the invention is at most 15%, more preferably at most 10%. (The carbon content of the catalyst referred to herein is based on the weight of the catalyst having been oxidized at a temperature not lower than 400° C. until it shows no more weight loss, and is represented in terms of % by weight of carbon in the catalyst. The same shall apply hereinunder.) Most used catalysts have a carbon content of from 10 to 70% or so, and their carbon content can be reduced through regeneration treatment to remove the carbonaceous substances from them. The activity of used catalysts having a large carbon content is low, as their surfaces are covered with carbonaceous substances. Reducing the carbon content of such used catalysts through regeneration treatment recovers their activity. The carbon content and the sulfur content of catalysts are measured with a C and S co-analyzer.

(4) The catalyst regeneration treatment is accompanied by oxidation of catalysts, generally by firing of catalysts. During the treatment, therefore, the catalyst surface is often overheated whereby the pore structures of the treated catalysts will be changed and the condition of the metal carried in the catalysts will be also changed. As a result, the catalyst activity will be often lowered. The specific surface area and the pore volume of regenerated catalysts may be the factors indicating their catalytic activity, and based on these, the activity of regenerated catalysts can be evaluated. The specific surface area and the pore volume of catalysts gradually decrease while the catalysts are used for hydrogenation, since some impurities adhere to the used catalysts and since the catalysts are degraded under heat during the reaction. For the regenerated catalysts usable in the invention, it is desirable that their specific surface area and pore volume are both still at least 70% of the initial values of the fresh catalysts. For the concrete physical data of the regenerated catalysts, it is desirable that their specific surface area falls between 60 and 200 $m^2/g$, more preferably between 10 and 200 $m^2/g$, and their pore volume falls between 0.3 and 1.0 cc/g. These data are obtained through nitrogen absorption.

(5) The regenerated catalysts are used for hydrogenation of heavy oil. Naturally, therefore, they must have the capability of hydrogenation. As their basic constitution, preferred are catalyst compositions comprising a metal oxide with molybdenum, tungsten, cobalt or nickel carried on an oxide carrier of, for example, alumina, alumina-phosphorus, alumina-boron, alumina-silicon or the like. (In the carrier, phosphorus, boron and silicon are in the form of their oxide, and the same shall apply hereinunder.) Of those, more preferred are catalysts of nickel/molybdenum carried on an alumina carrier; catalysts of nickel/molybdenum carried on an alumina-phosphorus carrier; catalysts of cobalt/molybdenum carried on an alumina-born carrier; and catalysts of nickel/molybdenum carried on an alumina-silicon carrier. In addition, since the catalysts are for processing heavy oil, it is also desirable that they contain the carried metals, cobalt or nickel, and molybdenum, in an amount of from 0.1 to 10% for cobalt or nickel and in an amount of from 0.2 to 25% for molybdenum. On the other hand, the phosphorus content of the catalysts preferably falls between 0.1 and 15%. (This is measured in the same manner as that for the metal content measurement noted above.)

3. Concrete reaction conditions for the first to third aspects of the invention:

(1) The first aspect of the invention for heavy oil hydro-desulfurization including hydro-denitrification is described concretely. The reaction conditions for this are not specifically defined, so far as the specific catalyst disposition is employed in this aspect. General conditions for this aspect are described. Regarding the catalyst disposition, it is desirable that a fresh catalyst for metal removal is disposed in the metal removal zone, and a fresh catalyst for desulfurization and denitrification is in the former half stage, 50%, of the desulfurization and denitrification zone while a regenerated catalyst for desulfurization and denitrification is in the latter half stage, 50%, thereof. The heavy oil to be processed herein may be any one mentioned above, but is preferably normal-pressure residual oil. Regarding the reaction conditions for it, the temperature may fall generally between 300 and 450° C., but preferably between 350 and 420° C.; the hydrogen partial pressure may fall generally between 7.0 and 25.0 Pa, but preferably between 10.0 and 15.0 Pa; the liquid hourly space velocity may fall generally between 0.01 and 10 $hrs^{-1}$, but preferably between 0.1 and 5 $hrs^{-1}$; and the ratio of hydrogen/oil may fall generally between 500 and 2500 $Nm^3/kl$, but preferably between 500 and 2000 $Nm^3/kl$.

To control the nitrogen content, the sulfur content and the metal content (nickel, vanadium) of the processed oil, the necessary factors of the reaction conditions noted above, for example, the reaction temperature may be suitably varied. According to the heavy oil hydro-denitrification of the invention as above, used catalysts which have heretofore been considered useless can be effectively recycled for denitrification of residual oil, etc.

(2) The second aspect of the invention for heavy oil hydro-desulfurization, which is characterized by the specific catalyst disposition as above, is described concretely. The reaction conditions for this are not specifically defined, so far as the specific catalyst disposition is employed in this aspect. General conditions for this aspect are described. The heavy oil to be processed herein may be any one mentioned above, but is preferably normal-pressure residual oil. Regarding the reaction conditions for it, the temperature may fall generally between 300 and 450° C., but preferably between 350 and 420° C.; the hydrogen partial pressure may fall generally between 7.0 and 25.0 Pa, but preferably between 10.0 and 15.0 Pa; the liquid hourly space velocity may fall generally between 0.01 and 10 $hrs^{-1}$, but preferably between 0.1 and 5 $hrs^{-1}$; and the ratio of hydrogen/oil may fall generally between 500 and 2500 $Nm^3/kl$, but preferably between 500 and 2000 $Nm^3/kl$.

To control the sulfur content and the metal content (nickel, vanadium) of the processed oil, the necessary factors of the reaction conditions noted above, for example, the reaction temperature may be suitably varied. According to the heavy oil hydro-desulfurization of the invention as above, used catalysts which have heretofore been considered useless can be effectively recycled for desulfurization of residual oil, etc.

(3) The third aspect of the invention for heavy oil hydrogenation is described concretely with reference to hydro-desulfurization of heavy oil. The reaction conditions for this are not specifically defined, so far as the specific catalyst disposition as combined with the specific mode of filling catalysts in the reaction zone is employed in this aspect. General conditions for this aspect are described. For the catalyst disposition, any and every mode mentioned above is employable. The embodiment of case 6 of FIG. 6 is referred to herein. In this embodiment, it is desirable that a fresh catalyst layer for hydrogenation and metal removal is disposed in the metal removal zone, which accounts for 10% of the total of all catalyst layers; a fresh catalyst layer for hydro-desulfurization is in 40% thereof in the former stage of the desulfurization zone; are generated catalyst layer for hydro-desulfurization is in the next 20% thereof; and a fresh catalyst layer for hydro-desulfurization is in the final 30% thereof.

The heavy oil to be processed herein may be any one mentioned above, but is preferably normal-pressure residual oil. Regarding the reaction conditions for it, the temperature may fall generally between 300 and 450° C., but preferably between 350 and420° C.; the hydrogen partial pressure may fall generally between 7.0 and 25.0 Pa, but preferably between 10.0 and 15.0 Pa; the liquid hourly space velocity may fall generally between 0.01 and 10 $hrs^{-1}$, but preferably between 0.1 and 5 $hrs^{-1}$; and the ratio of hydrogen/oil may fall generally between 500 and 2500 $Nm^3$/kl, but preferably between 500 and 2000 $Nm^3$/kl. In the case of the catalyst disposition mentioned above, the liquid hourly space velocity through the regenerated catalyst layer is preferably at least 1.0 $hr^{-1}$.

To control the sulfur content, the nitrogen content and the metal content (nickel, vanadium) of the processed oil, the necessary factors of the reaction conditions noted above, for example, the reaction temperature may be suitably varied. According to the heavy oil hydrogenation of the invention as above, used catalysts which have heretofore been considered useless can be effectively recycled for hydrogenation of residual oil, etc.

EXAMPLES

The invention is described concretely with reference to the following Examples, which, however, are not intended to restrict the scope of the invention.

Example 1 (first aspect of the invention)

A commercially-available catalyst carrying nickel and molybdenum on an alumina carrier (this is referred to as fresh catalyst 1) was filled in a residual oil hydro-desulfurization device, into which was applied normal-pressure residual oil from the Middle East, for 8000 hours. Hydro-desulfurizing the residual oil was continued while the reaction temperature was so monitored that the sulfur content of the essential fraction (distillate having a boiling point of not lower than 343° C.) of the processed oil could be stabilized on a constant level. This is to prepare a used catalyst from the fresh catalyst. Typical properties of the normal-pressure residual oil processed herein are given in Table 1; and the reaction conditions for desulfurization are in Table 2.

The used catalyst was taken out of the reactor, well washed with toluene, and then dried (this is referred to as washed catalyst 1). The washed catalyst was oxidized in air at 500° C. for 3 hours (the resulting catalyst is referred to as regenerated catalyst 1). The composition and the physical properties of these catalysts are given in Table 3.

50 cc of the regenerated catalyst 1 was filled in the former stage of a small-sized, high-pressure fixed-bed reactor (capacity: 200 cc), and 50 cc of the fresh catalyst 1 in the latter stage thereof. Through the reactor, first passed was light-gravity gas oil (its sulfur content was controlled to be 2.5% by adding thereto a sulfurizing agent, DMDS), at a flow rate of 135 kg/$cm^3$ of hydrogen at 250° C. for 24 hours for pre-sulfurization. Next, the normal-pressure residual oil mentioned above was passed through it for hydro-denitrification. The reaction conditions are given in Table 6; and the properties of the processed oil are in Table 7.

Example 2 (first aspect of the invention)

The same process as in [Example 1] was repeated, except that 25 cc of the regenerated catalyst 1 was filled in the former stage of a small-sized, high-pressure fixed-bed reactor (capacity: 200 cc), and 75 cc of the fresh catalyst 1 in the latter stage thereof. The properties of the processed oil are given in Table 7.

Example 3 (first aspect of the invention)

In the same manner as in [Example 1], washed catalyst 2 and regenerated catalyst 2 were prepared from a commercially-available catalyst carrying nickel and molybdenum on an alumina-phosphorus carrier (this is referred to as fresh catalyst 2). The composition and the physical properties of these catalysts are given in Table 4. Next, the same process as in [Example 1] was repeated, except that 50 cc of the regenerated catalyst 2 was filled in the former stage of a small-sized, high-pressure fixed-bed reactor (capacity: 200 cc), and 50 cc of the fresh catalyst 2 in the latter stage thereof. The properties of the processed oil are given in Table 7.

Example 4 (first aspect of the invention)

Like in [Example 1], the fresh catalyst 1 was filled in a reduced-pressure light oil hydro-desulfurization device, into which was applied reduced-pressure light oil from the Middle East, for 8000 hours. Hydro-desulfurizing the light oil was continued while the reaction temperature was so monitored that the sulfur content of the essential fraction (distillate having a boiling point of not lower than 360° C.) of the processed oil could be stabilized on a constant level. This is to prepare a used catalyst from the fresh catalyst. The properties of the reduced-pressure light oil processed herein are given in Table 1; and the reaction conditions for desulfurization are in Table 2. From the used catalyst, prepared were washed catalyst 3 and regenerated catalyst 3 in the same manner as in [Example 1]. The composition and the physical properties of these catalysts are given in Table 5. Next, the same process as in [Example 1] was repeated, except that 50 cc of the regenerated catalyst 3 was filled in the former stage of a small-sized, high-pressure fixed-bed reactor (capacity: 200 cc), and 50 cc of the fresh catalyst 1 in the latter stage thereof. The properties of the processed oil are given in Table 7.

Example 5 (second aspect of the invention)

50 cc of the fresh catalyst 1 was filled in the former stage of a small-sized, high-pressure fixed-bed reactor (capacity: 200 cc), and 50 cc of the regenerated catalyst 1 in the latter stage thereof. Through the reactor, first passed was light-gravity gas oil (its sulfur content was controlled to be 2.5% by adding thereto a sulfurizing agent, DMDS), at a flow rate of 135 kg/$cm^3$ of hydrogen at 250° C. for 24 hours for pre-sulfurization. Next, the normal-pressure residual oil mentioned above was passed through it for desulfurization. The reaction conditions are given in Table 6; and the properties of the processed oil are in Table 7.

Example 6 (second aspect of the invention)

The same process as in [Example 5] was repeated, except that 75 cc of the fresh catalyst 1 was filled in the former stage of a small-sized, high-pressure fixed-bed reactor (capacity: 200 cc), and 25 cc of the regenerated catalyst 1 in the latter stage thereof. The properties of the processed oil are given in Table 7.

Example 7 (second aspect of the invention)

The same process as in [Example 5] was repeated, except that 50 cc of the fresh catalyst 2 was filled in the former stage of a small-sized, high-pressure fixed-bed reactor (capacity: 200 cc), and 50 cc of the regenerated catalyst 2 in the latter stage thereof. The properties of the processed oil are given in Table 7.

Example 8 (second aspect of the invention)

The same process as in [Example 5] was repeated, except that 50 cc of the fresh catalyst 1 was filled in the former stage of a small-sized, high-pressure fixed-bed reactor (capacity: 200 cc), and 50 cc of the regenerated catalyst 3 in the latter stage thereof. The properties of the processed oil are given in Table 7.

Example 9 (third aspect of the invention)

A small-sized, high-pressure fixed-bed reactor (capacity: 200 cc) was filled with 25 cc of the fresh catalyst 1, then 25 cc of the regenerated catalyst 1, then 25 cc of the fresh catalyst 1, and finally 25 cc of the regenerated catalyst 1 in that order from the upstream side of oil flow. Through the reactor, first passed was light-gravity gas oil (its sulfur content was controlled to be 2.5% by adding thereto a sulfurizing agent, DMDS), at a flow rate of 135 kg/cm$^3$ of hydrogen at 250° C. for 24 hours for pre-sulfurization. Next, the normal-pressure residual oil mentioned above was passed through it for hydrogenation. The reaction conditions are given in Table 6; and the properties of the processed oil are in Table 7.

Example 10 (third aspect of the invention)

The same process as in [Example 9] was repeated, except that a small-sized, high-pressure fixed-bed reactor (capacity: 200 cc) was filled with 45 cc of the fresh catalyst 1, then 25 cc of the regenerated catalyst 1, and finally 30 cc of the fresh catalyst 1 in that order from the upstream side of oil flow. The properties of the processed oil are given in Table 7.

Example 11 (third aspect of the invention)

The same process as in [Example 9] was repeated, except that a small-sized, high-pressure fixed-bed reactor (capacity: 200 cc) was filled with 10 cc of the fresh catalyst 2, then 25 cc of the regenerated catalyst 2, then 30 cc of the fresh catalyst 2, then 25 cc of the regenerated catalyst 2, and finally 10 cc of the fresh catalyst 2 in that order from the upstream side of oil flow. The properties of the processed oil are given in Table 7.

Example 12 (third aspect of the invention)

The same process as in [Example 9] was repeated, except that a small-sized, high-pressure fixed-bed reactor (capacity: 200 cc) was filled with 30 cc of the fresh catalyst 1, then 50 cc of the regenerated catalyst 3, and finally 20 cc of the fresh catalyst 1 in that order from the upstream side of oil flow. The properties of the processed oil are given in Table 7.

Example 13 (third aspect of the invention)

The same process as in [Example 1] was repeated, except that a small-sized, high-pressure fixed-bed reactor (capacity: 200 cc) was filled with a mixed catalyst that had been prepared by uniformly mixing 50 cc of the fresh catalyst 1 and 50 cc of the regenerated catalyst 1. The properties of the processed oil are given in Table 7.

TABLE 1

| Items Measured | Normal-Pressure Residual Oil | Reduced-Pressure Light Oil | Method for Measurement |
|---|---|---|---|
| Density (15° C., g/cm$^3$) | 0.962 | 0.916 | JIS K-2249 |
| Kinematic Viscosity (50° C., cSt) | 290 | 61 | JIS K-2283 |

TABLE 1-continued

| Items Measured | Normal-Pressure Residual Oil | Reduced-Pressure Light Oil | Method for Measurement |
|---|---|---|---|
| Carbonaceous Residue (wt. %) | 9.33 | 0.23 | JIS K-2270 |
| Asphaltene (wt. %) | 2.98 | — | IP 143 |
| Impurity Content (by weight) | | | |
| Sulfur Content (%) | 3.48 | 2.42 | JIS K-2541 |
| Nitrogen Content (ppm) | 1840 | 1010 | JIS K-2609 |
| Vanadium Content (ppm) | 37.6 | 0.2 | JPI-5S-10-79 |
| Nickel Content (ppm) | 10.8 | — | JPI-5S-11-79 |
| Distillate Fractions (% by volume) | | | JIS K-2254 |
| up to 340° C. | 6.2 | 6.3 | |
| from 340 to 525° C. | 46.2 | 86.2 | |
| over 525° C. | 47.6 | 7.5 | |

TABLE 2

| Starting Oil | Example 1 normal-pressure residual oil | Example 4 reduced-pressure light oil |
|---|---|---|
| Hydrogen Partial Pressure (kg/cm$^2$) | 130 | 60 |
| Liquid Hourly Space Velocity (/hr) | 0.3 | 1.8 |
| Ratio of Hydrogen/Oil (Nm$^3$/kl) | 850 | 500 |
| Sulfur Content of Essential Fraction of Processed Oil (wt. %) | 0.3 | 0.25 |
| Reaction Time Continued (hr) | 8000 | 8000 |

TABLE 3

| Type of Catalyst | Fresh Catalyst 1 | Washed Catalyst 1 | Regenerated Catalyst 1 |
|---|---|---|---|
| Carrier | alumina | alumina | alumina |
| Metal Content (wt. %) | | | |
| molybdenum | 8.8 | 8.2 | 8.3 |
| nickel | 2.4 | 3.2 | 3.2 |
| vanadium | — | 7.4 | 7.4 |
| Carbon Content (wt. %) | — | 28.3 | 0.8 |
| Pore Structure | | | |
| Specific Surface Area (m$^2$/g) | 197 | 96 | 167 |
| Pore Volume (cc/g) | 0.6 | 0.25 | 0.52 |

TABLE 4

| Type of Catalyst | Fresh Catalyst 2 | Washed Catalyst 2 | Regenerated Catalyst 2 |
|---|---|---|---|
| Carrier | alumina/phosphorus (1.7%) | alumina/phosphorus (1.6%) | alumina/phosphorus (1.6%) |
| Metal Content (wt. %) | | | |
| molybdenum | 8.8 | 8.0 | 8.1 |
| nickel | 2.3 | 3.9 | 3.9 |
| vanadium | — | 15.1 | 15.1 |
| Carbon Content (wt. %) | — | 23.3 | 0.6 |
| Pore Structure | | | |
| Specific Surface Area (m$^2$/g) | 183 | 88 | 145 |
| Pore Volume (cc/g) | 0.6 | 0.25 | 0.52 |

TABLE 5

| Type of Catalyst | Fresh Catalyst 3 | Washed Catalyst 3 | Regenerated Catalyst 3 |
|---|---|---|---|
| Carrier | alumina | alumina | alumina |
| Metal Content (wt. %) | | | |
| molybdenum | 8.8 | 8.8 | 8.8 |
| nickel | 2.4 | 2.3 | 2.3 |
| vanadium | | 0.6 | 0.6 |
| Carbon Content (wt. %) | | 16.6 | 0.2 |
| Pore Structure | | | |
| Specific Surface Area ($m^2/g$) | 197 | 122 | 184 |
| Pore Volume (cc/g) | 0.6 | 0.34 | 0.52 |

TABLE 6

| Starting Oil | Normal-Pressure Residual Oil |
|---|---|
| Reaction Temperature (° C.) | 370 |
| Hydrogen Partial Pressure ($kg/cm^2$) | 135 |
| Liquid Hourly Space Velocity (/hr) | 0.3 |
| Ratio of Hydrogen/Oil ($Nm^3/kl$) | 850 |
| Reaction Time Continued (hr) | 500 |

TABLE 7

| | Nitrogen Content (ppm by weight) | Sulfur Content (% by weight) | Metal Content (V + Ni) (ppm by weight) |
|---|---|---|---|
| Starting Oil (normal-pressure residual oil) | 1840 | 3.48 | 48 |
| Example 1 | 720 | 0.46 | 16 |
| Example 2 | 680 | 0.32 | 12 |
| Example 3 | 640 | 0.41 | 19 |
| Example 4 | 650 | 0.29 | 8 |
| Example 5 | 810 | 0.34 | 11 |
| Example 6 | 770 | 0.26 | 8 |
| Example 7 | 740 | 0.30 | 15 |
| Example 8 | 660 | 0.28 | 8 |
| Example 9 | 700 | 0.32 | 10 |
| Example 10 | 670 | 0.24 | 8 |
| Example 11 | 620 | 0.29 | 13 |
| Example 12 | 650 | 0.27 | 8 |
| Example 13 | 690 | 0.30 | 9 |

INDUSTRIAL APPLICABILITY

As described in detail hereinabove, in the method of heavy oil hydrogenation of the invention for which the catalyst disposition is specifically defined, heavy oil can be well hydrogenated under the same conditions as those for ordinary heavy oil hydrogenation with fresh catalysts. The method is significantly effective for efficient utilization of used catalysts.

What is claimed is:

1. A method of hydro-denitrifying heavy oil in a reaction zone filled with a catalyst, which is characterized by catalyst disposition of such that a regenerated catalyst is disposed in the former stage of at least a part of the reaction zone and a fresh catalyst is disposed in the latter stage thereof, (i) the regenerated catalyst being obtained by first washing and then oxidizing a used catalyst and (ii) the regenerated catalyst and the fresh catalyst being carried on an oxide carrier of alumina containing at least one oxide of phosphorus, boron or silicon.

2. The hydro-denitrifying method as claimed in claim 1, wherein the amount of the fresh catalyst filled in at least a part of the reaction zone falls between 20 and 95% by volume and that of the regenerated catalyst filled therein falls between 5 and 80% by volume.

3. A method of hydro-desulfurizing heavy oil in a reaction zone filled with a catalyst, which is characterized by catalyst disposition of such that a fresh catalyst is disposed in the former stage of at least a part of the reaction zone and a regenerated catalyst is disposed in the latter stage thereof, (i) the regenerated catalyst being obtained by first washing and then oxidizing a used catalyst and (ii) the regenerated catalyst and the fresh catalyst being carried on an oxide carrier of alumina containing at least one oxide of phosphorus, boron or silicon.

4. The hydro-desulfurizing method as claimed in claim 3, wherein the amount of the regenerated catalyst filled in at least a part of the reaction zone falls between 5 and 80% by volume and that of the fresh catalyst filled therein falls between 20 and 95% by volume.

5. A method of hydrogenating heavy oil, for which is used a reaction zone comprising at least three reaction layers of regenerated catalyst layers and fresh catalyst layers disposed alternately, (i) the regenerated catalyst being obtained by first washing and then oxidizing a used catalyst and (ii) the regenerated catalyst and the fresh catalyst being carried on an oxide carrier of alumina containing at least one oxide of phosphorus, boron or silicon.

6. The method of hydrogenating heavy oil as claimed in claim 5, wherein the liquid hourly space velocity (LHSV) of the heavy oil passing through the regenerated catalyst layer to be hydrogenated therethrough is larger than 1 $hr^{-1}$.

7. A method of hydrogenating heavy oil, for which is used a reaction zone comprising a regenerated catalyst and a fresh catalyst and having at least a mixed layer of the two, (i) the regenerated catalyst being obtained by first washing and then oxidizing a used catalyst and (ii) the regenerated catalyst and the fresh catalyst being carried on an oxide carrier of alumina containing at least one oxide of phosphorus, boron or silicon.

8. The method of hydrogenating heavy oil as claimed in claim 5, wherein the amount of the regenerated catalyst filled in the reaction zone falls between 5 and 80% by volume and that of the fresh catalyst filled therein falls between 20 and 95% by volume.

9. The method of hydrogenating heavy oil as claimed in claim 5, wherein the vanadium content of the regenerated catalyst is at most 35% by weight.

10. The method of hydrogenating heavy oil as claimed in claim 5, wherein the carbon content of the regenerated catalyst is at most 15% by weight.

11. The method of hydrogenating heavy oil as claimed in claim 5, wherein the specific surface area of the regenerated catalyst falls between 60 and 200 $m^2/g$.

12. The method of hydrogenating heavy oil as claimed in claim 5, wherein the pore volume of the regenerated catalyst falls between 0.3 and 1.0 cc/g.

13. The method of hydrogenating heavy oil as claimed in claim 5, wherein the regenerated catalyst is from a used catalyst having at least one metal of molybdenum, tungsten, cobalt and nickel carried on said oxide carrier, the catalyst having been used for hydrogenating mineral oil and then regenerated.

14. The method of hydrogenating heavy oil as claimed in claim 13, wherein the metal carried on said oxide carrier is nickel and molybdenum.

15. The method of hydrogenating heavy oil as claimed in claim 13, wherein the metal carried on said oxide carrier is nickel or cobalt, and molybdenum.

16. The method of hydrogenating heavy oil as claimed in claim 13, wherein the nickel or cobalt content of the catalyst having the metal carried on its carrier falls between 0.1 and 10% by weight and the molybdenum content thereof falls between 0.1 and 25% by weight.

17. The method of hydrogenating heavy oil as claimed in claim 9, which is for hydro-denitrifying heavy oil.

18. The method of hydrogenating heavy oil as claimed in claim 9, which is for hydro-desulfurizing heavy oil.

19. The method of hydrogenating heavy oil as claimed in claim 7, wherein the vanadium content of the regenerated catalyst is at most 35% by weight.

20. The method of hydrogenating heavy oil as claimed in claim 7, wherein the carbon content of the regenerated catalyst is at most 15% by weight.

21. The method of hydrogenating heavy oil as claimed in claim 7, wherein the specific surface area of the regenerated catalyst falls between 60 and 200 $m^2/g$.

22. The method of hydrogenating heavy oil as claimed in claim 7, wherein the pore volume of the regenerated catalyst falls between 0.3 and 1.0 cc/g.

23. The method of hydrogenating heavy oil as claimed in claim 7, wherein the regenerated catalyst is from a used catalyst having at least one metal of molybdenum, tungsten, cobalt and nickel carried on said oxide carrier, the catalyst having been used for hydrogenating mineral oil and then regenerated.

24. The method of hydrogenating heavy oil as claimed in claim 23, wherein the metal carried on said oxide carrier is nickel and molybdenum.

25. The method of hydrogenating heavy oil as claimed in claim 23, wherein the metal carried on said oxide carrier is nickel or cobalt, and molybdenum.

26. The method of hydrogenating heavy oil as claimed in claim 23, wherein the nickel or cobalt content of the catalyst having the metal carried on its carrier falls between 0.1 and 10% by weight and the molybdenum content thereof falls between 0.1 and 25% by weight.

27. The method of hydrogenating heavy oil as claimed in claim 19, which is for hydro-denitrifying heavy oil.

28. The method of hydrogenating heavy oil as claimed in claim 19, which is for hydro-desulfurizing heavy oil.

* * * * *